United States Patent [19]

Barreiro

[11] Patent Number: 4,718,408

[45] Date of Patent: Jan. 12, 1988

[54] VARIABLE MASSAGE APPARATUS HAVING A CLUTCH SELECTIVELY ENGAGING ALTERNATE GEARS

[76] Inventor: Armando Barreiro, 9460 NW. 13 St., Bay #69, Miami, Fla. 33172

[21] Appl. No.: 857,187

[22] Filed: Apr. 29, 1986

[51] Int. Cl.[4] ..... A61H 7/00; A61H 23/02

[52] U.S. Cl. ..... 128/52; 128/57; 128/55

[58] Field of Search ..... 128/52, 57, 44, 51, 128/55, 60, 61, 59

[56] References Cited

U.S. PATENT DOCUMENTS

| | | | |
|---|---|---|---|
| 2,541,872 | 2/1951 | Hendricks | 192/48.91 |
| 2,775,908 | 1/1957 | Elliott et al. | 192/48.91 |
| 3,135,129 | 6/1964 | Merritt | 192/94 |
| 3,800,785 | 4/1974 | Inada | 128/52 |
| 3,939,826 | 2/1976 | Fujimoto | 128/55 |
| 4,009,710 | 3/1977 | Inada | 128/57 |
| 4,079,732 | 3/1978 | Shinichiro | 128/57 |
| 4,115,336 | 10/1986 | Fijimoto | 128/52 |
| 4,149,531 | 4/1979 | Toyoshima et al. | 128/52 |
| 4,422,448 | 12/1983 | Sugai et al. | 128/57 |
| 4,557,359 | 10/1985 | Woodbridge | 192/94 |

*Primary Examiner*—Edgar S. Burr
*Assistant Examiner*—Tonya Lamb

[57] ABSTRACT

An apparatus for massaging mountable behind the back of a chair and capable of being moved vertically to provide relaxing massage to a user sitting on the chain. A reversible motor mechanism provides the rotational motion to a clutch assembly that selectively engages one of two gear assemblies that in turn activate two different linkage and reciprocating mechanisms that simulate or follow the movements of the fingers of a conventional masseur.

2 Claims, 8 Drawing Figures

VARIABLE MASSAGE APPARATUS HAVING A CLUTCH SELECTIVELY ENGAGING ALTERNATE GEARS

BACKGROUND OF THE INVENTION

1. Field of the Invention

The present invention relates to a massage apparatus, and more particularly, to such apparatuses that are installed in the back rest of a chair.

2. Description of the Related Art

Massaging mechanisms of many different designs have been designed in the past that are installed in the back rest of chairs. One of these designs is disclosed in U.S. Pat. No. 4,422,448; issued to Sugai. The massaging mechanism is moved vertically with rack 37 and pinion 41. Upward and downward massage is provided depending on the rotation of massaging wheels 45, which in turn depends on the rotation of feed shaft 47. The massage provided by this complicated mechanism is basically the same for both directions of rotation of shaft 47.

In U.S. Pat. No. 4,149,531 issued to Tanaka et al a vertical elongated screw bar 17 is disclosed and is driven by a motor through a V-belt and pulleys transmission. Roller assembly 3 is driven up and down by screw bar 17. Again the motor only provides one type of massage and a substantial portion of the mechanism would have to be replaced to obtain a different type of massage.

Other patents describing the closest subject matter provide for a number of more or less complicated features that fail to solve the problem of using one motor to provide only one type of massage in an efficient and economical way. None of these patents suggest the novel features of the present invention.

SUMMARY OF THE INVENTION

It is one of the main objects of the present invention to provide a massage apparatus that is capable of delivering a kneading type of massage when its driving shaft is rotated in one direction and a tapping type of massage when rotating in the other direction.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
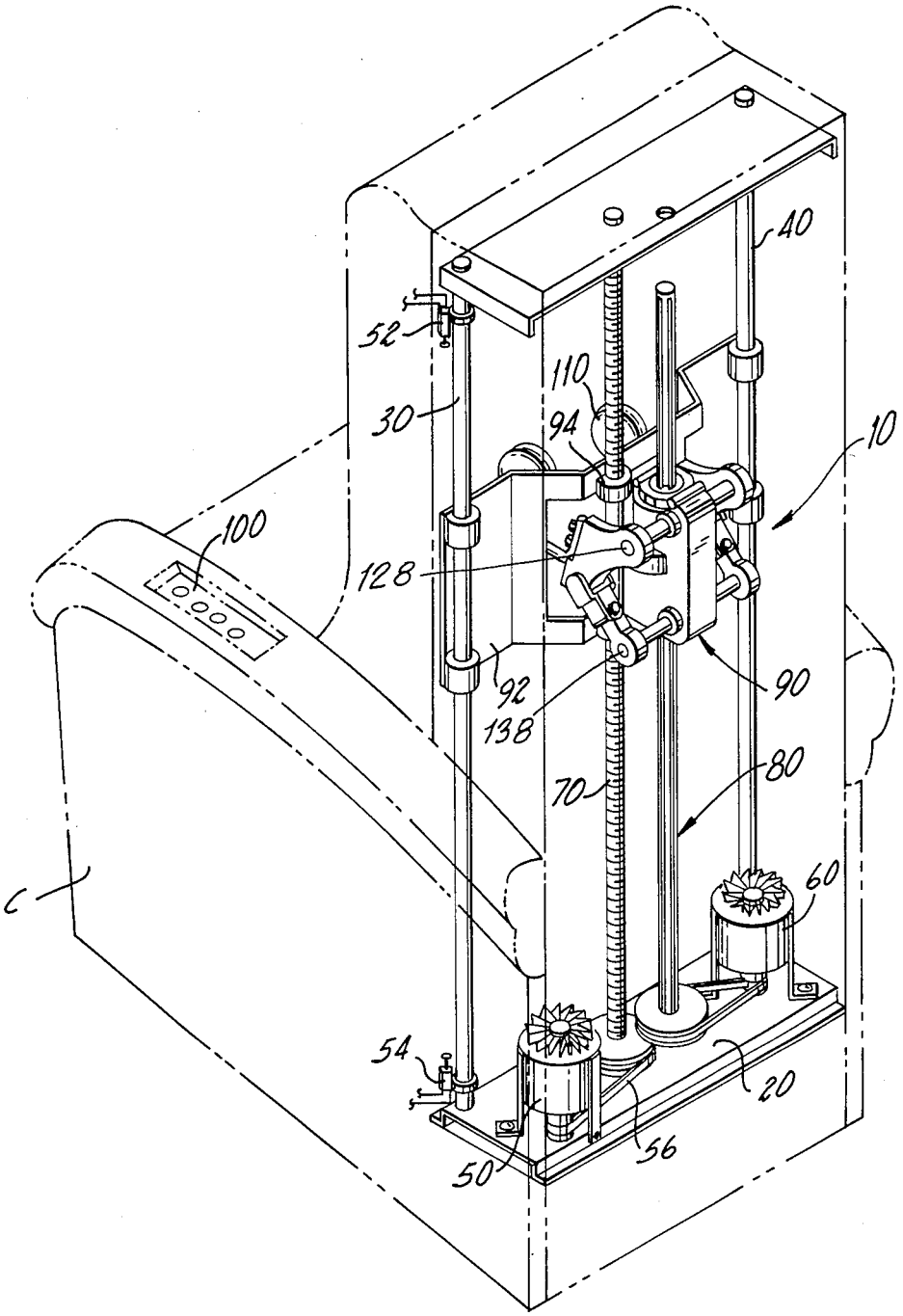
FIG. 1 represents a view in perspective of the back of a chair incorporating the massage apparatus.

Referring now to FIG. 1, it can be seen that a conventional chair C incorporates the present invention which generally referred to with numeral 10. Massage machine 10, basically, comprises platform assembly 20, guide members 30 and 40, first and second motor means 50 and 60, vertical motion shaft 70, rotational drive shaft 80 and massage mechanism unit or assembly 90.

Massage mechanism 90 is moved vertically up and down guided by guide members 30 and 40 that are slidably engaged to support member 92. Unit 90 is securely mounted to support member 92. Motor means 50 is a reversible motor that changes the direction of rotation when the polarity of the electricity applied is changed. Support member 92 includes threaded element 94 that is rigidly mounted thereto. When support member is moved vertically through threaded vertical motion shaft 70 and threaded element 94 and reaches either the upper end or the lower end, switch assembly 52 or 54 is actuated which cause a relay (not shown) to change the polarity of motor means 50 to change causing support member 92 to move in the opposite direction in response to the reversal of the rotation of motor means 50. This manner of changing the polarity applied to a device using switches and relays is well known in the art. The polarity can also be manually changed by the user if he or she desires to concentrate on a particular area of the body. In the preferred embodiment belt means 56 are used to transmit the rotational motion of motor means 50 to vertical motion shaft 70, but other means may also be used.

Motor means 60 is also a reversible electric motor and the direction of its rotation is controlled by the user through switches and timers in control panel 100 in a conventional way. For example, the rotation in one direction may be programmed to be active for a certain amount of time and switching back to the other direction after that. Also, the rotational motion of motor means 60 may be manually controlled. As will be described below, the direction of rotation will determine the type of massage received by the user, i.e., kneading, tapping or any other massage designed with a particular arrangement of linkage mechanism 150.

Figure 2:
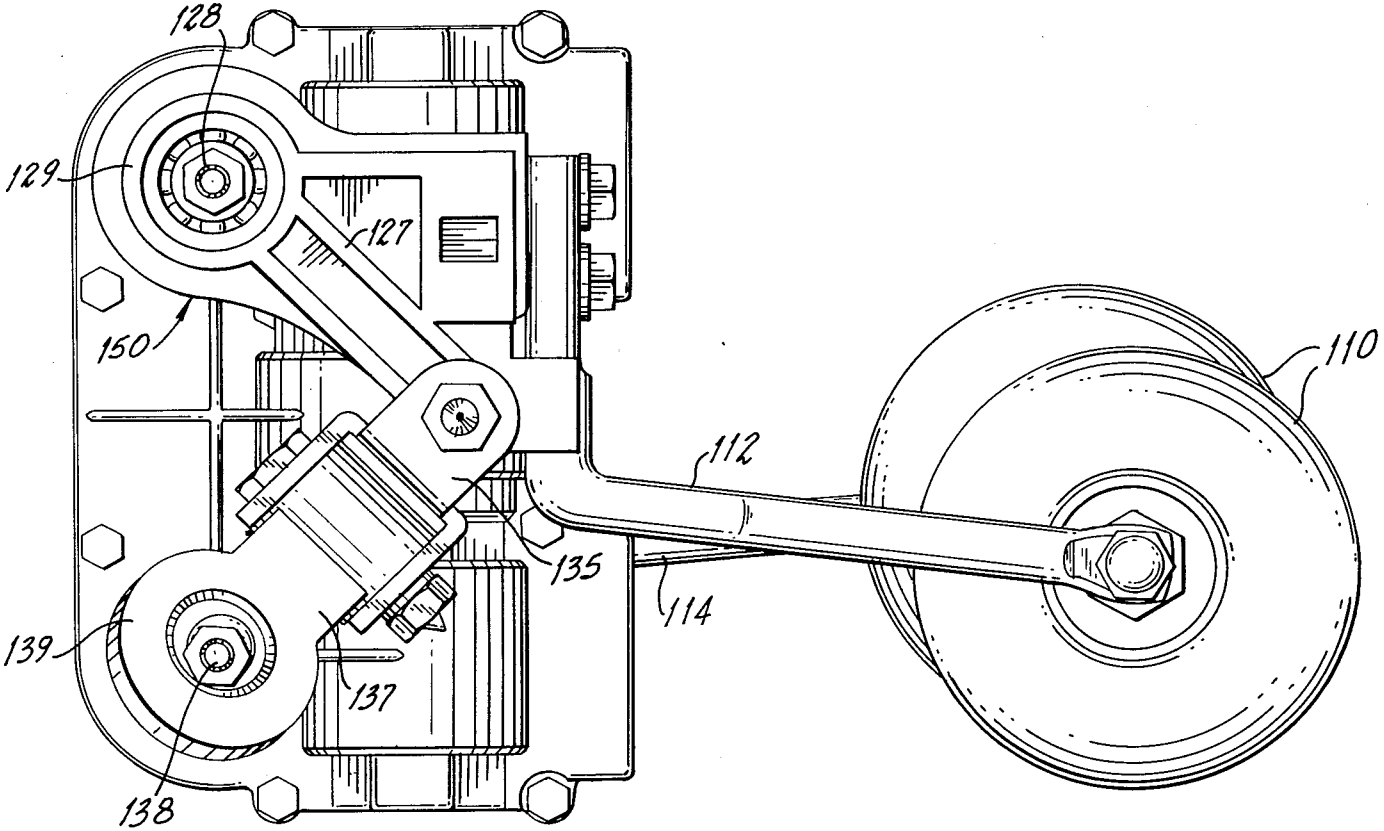
FIG. 2 shows an elevational side view of the massage mechanism unit or assembly as it would be seen from the right side of the chair shown in FIG. 1.
Figure 3:
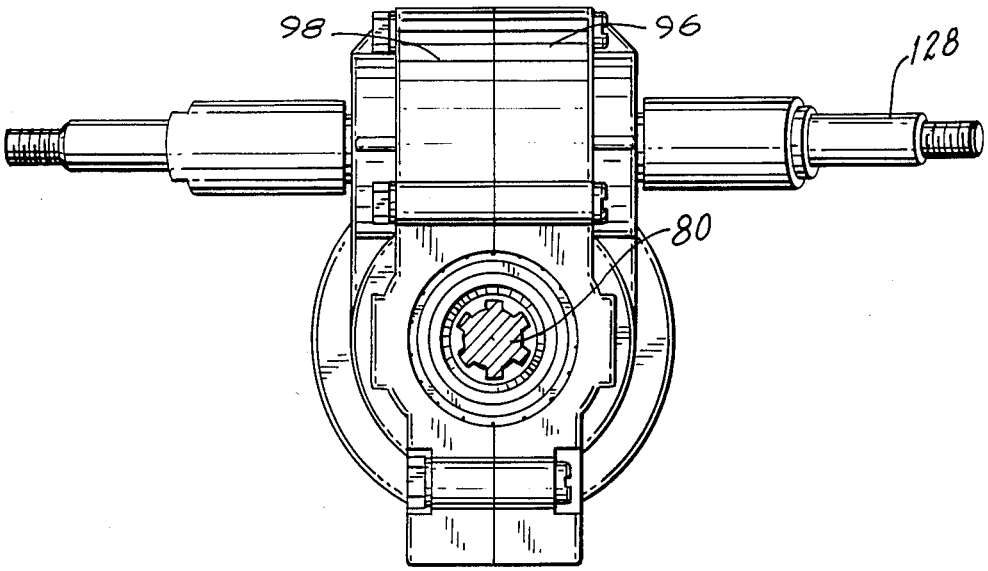
FIG. 3 illustrates a top view of the massage mechanism assembly as it is seen from above the chair of FIG. 1 with all surrounding components removed.
Figure 4:
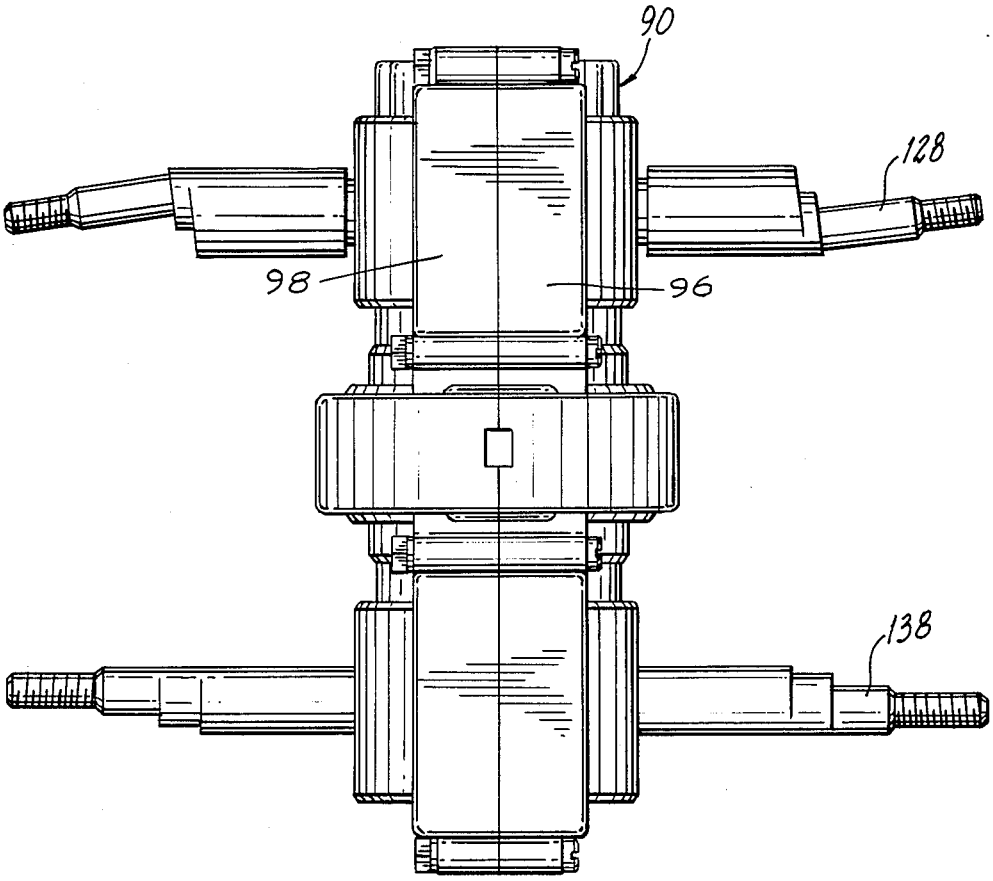
FIG. 4 is a representation of the front view of the massage mechanism assembly as seen from the front of the chair of FIG. 1 looking through its backrest.
Figure 5:
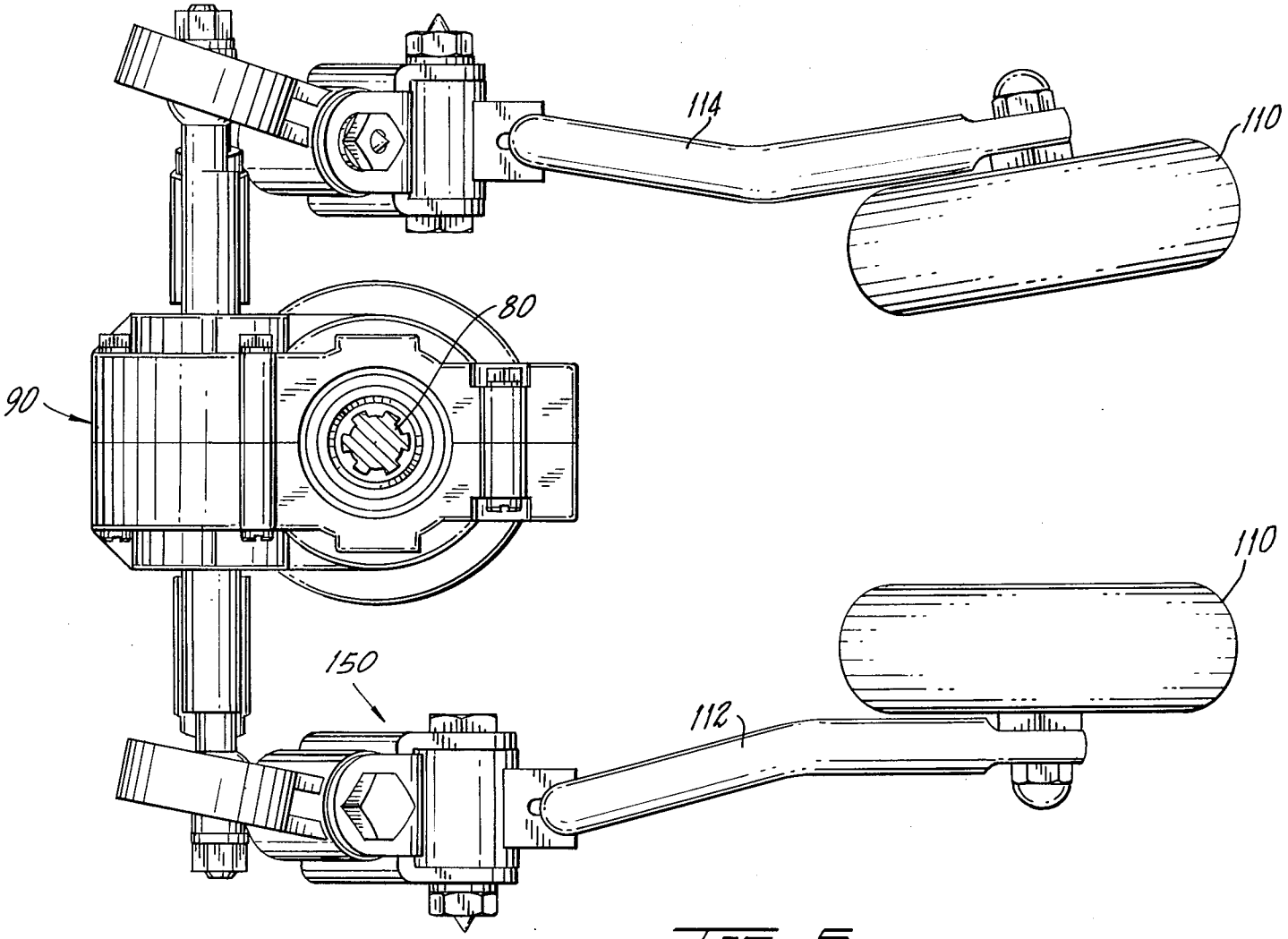
FIG. 5 shows a bottom view of the massage mechanism assembly with the linkage, mechanism.

FIGS. 2; 3; 4; 5; 6 and 7 show different views of the massage mechanism unit 90 including housing cover members 96 and 98. Wheels 110 come in contact with the back of chair C so that a user may feel its presence when the unit is activated. Wheels 110 are made out of a solid rubber material, preferably, so that a firm yet somewhat cushioned touch is provided to the user's back. Arm members 112 and 114 rotatably support wheels 110 and rigidly engage to linkage mechanism 150. As can be seen from FIG. 2, linkage mechanism 150 includes, in the preferred embodiment, ball bearings 129 and 139 rotatably mounted to the eccentric ends of shafts 128 and 138. A reciprocating movement is transmitted to legs 127 and to pivotally mounted legs 135 and 137. One end of leg 127 and one end of leg 135 are pivotally mounted together.

Figure 7:
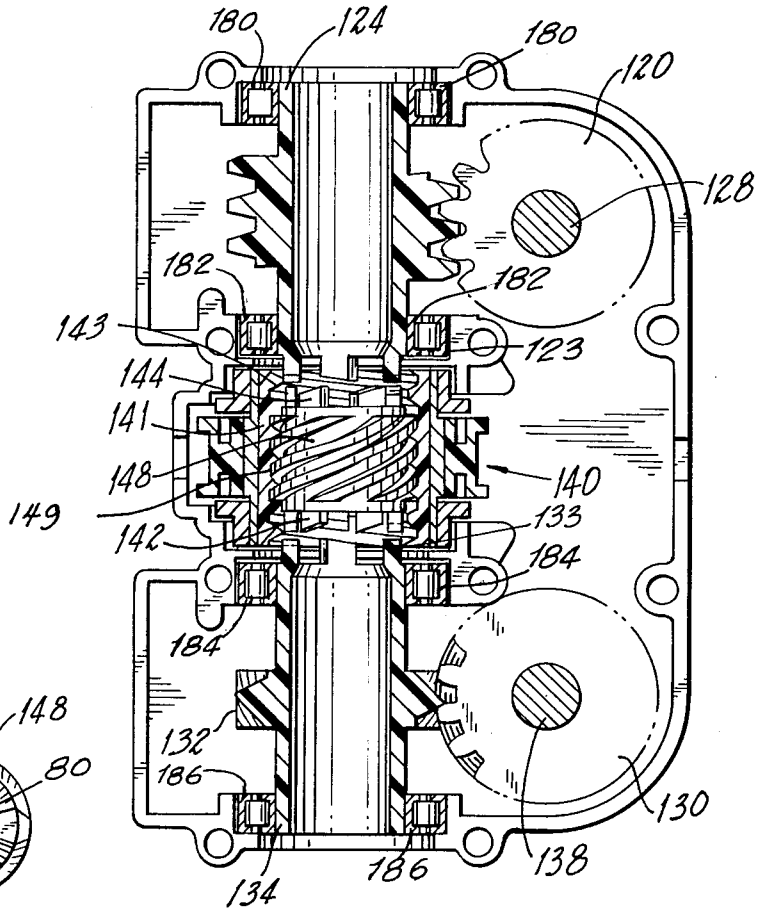
FIG. 7 shows a cross-sectional view of several of the components seen in FIG. 6.
Figure 7A:
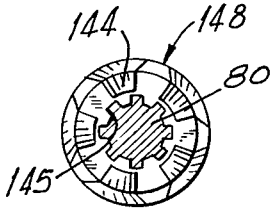
FIG. 7A shows a top view of clutch member 148 illustrating its internal teeth and outer thread.
Figure 6:
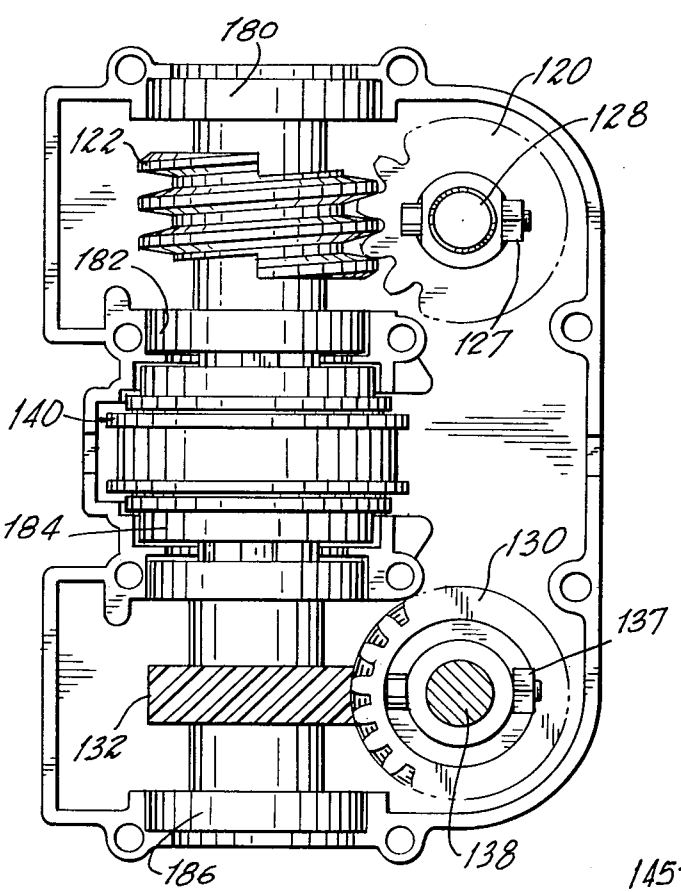
FIG. 6 illustrates an elevational side view of the massage mechanism assembly without the cover showing the relative position of the internal components of the massage mechanism assembly.

Referring now to FIGS. 6 and 7, where the internal components of unit 90 may be appreciated, it can be seen that gear members 120 and 130 are meshed with worm screw member 122 and gear 132, respectively. Clutch assembly 140 includes clutch member 148 which is a cylindrical piece with an external thread 149. Clutch member 148 is shown in in FIG. 7 and FIG. 7A. Thread 149 engages with cylindrical clutch housing 141 which includes an internal compatible thread 143 over which clutch member 148 travels. Clutch member 148 is provided with teeth 144 and 142 that engages with cooperating teethed ends 123 and 133 of shafts 124 and 134, respectively. Shaft 124 rotates freely on bearings 180 and 182 and shaft 134 rotates on bearings 184 and 186, as shown in FIG. 7. The rotation of rotational drive shaft 80 is transmitted to internal teeth 145 of clutch member 148 as shown in FIG. 7A. If motor means 60 rotates in one direction and, for instance, shaft 124 is engaged, the rotation of gear 120 produces one type of massage (kneading) and if the direction of rotation is changed a different type of massage is delivered (tapping). What determines the kind of massage that is delivered are driving shafts 128 and 138 and the configuration of linkage assembly 150. But only one massage unit and one reversible motor assembly is needed to deliver two different types of massages by just changing the direction of rotation of the motor.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A massage apparatus mountable behind the back of a chair, comprising:

A. a flat horizontal platform;

B. vertically extending guiding means mounted perpendicularly to said platform;

C. motor means mounted on said platform including a shaft that is disposed in parallel to said guiding means;

D. a massage mechanism unit slidably mounted over said guiding means and including two sets of gears and clutch means for transmitting the rotation of said shaft and for selectively engaging one of said sets of gears depending on the direction of rotation of the shaft of said motor means and said clutch means further including a clutch member of cylindrical shape and having an external thread and a cylindrical clutch housing coaxially housing said clutch member, said housing including an internal thread compatible with said external thread thereby allowing said clutch member to longitudinally travel inside said housing to engage one of said two gears connected to said shaft member;

E. two shaft members rigidly connected to each one of said gears;

F. linkage means having two ends and said linkage means being pivotally mounted to said two shaft members on one end and further including each of said linkage means having at least one rubber wheel rotatably mounted at the other end so that the rotation of said gears impart a predetermined reciprocating movement to the ends having said wheels mounted thereon and said wheels positioned in the area behind the back of said chair so that said unit may travel up and down the spine of a user.

2. The apparatus set forth in claim 1 wherein said clutch member has two ends each having a plurality of teeth longitudinally disposed and said two shafts include cooperating teeth to engage said clutch member.

* * * * *